US008162135B2

(12) United States Patent
Oliveira

(10) Patent No.: US 8,162,135 B2
(45) Date of Patent: Apr. 24, 2012

(54) PACKAGE FOR CONTAINERS

(75) Inventor: Steven Manuel Oliveira, Nashua, NH (US)

(73) Assignee: Graphic Packaging International, Inc., Marietta, GA (US)

( * ) Notice: Subject to any disclaimer, the term of this patent is extended or adjusted under 35 U.S.C. 154(b) by 270 days.

(21) Appl. No.: 11/668,840

(22) Filed: Jan. 30, 2007

(65) Prior Publication Data

US 2008/0135423 A1 Jun. 12, 2008

Related U.S. Application Data

(60) Provisional application No. 60/763,654, filed on Jan. 31, 2006.

(51) Int. Cl.
*B65D 71/00* (2006.01)

(52) U.S. Cl. ..... 206/147; 206/427; 206/434

(58) Field of Classification Search ..... 206/147, 206/486, 427, 429, 431, 434
See application file for complete search history.

(56) References Cited

U.S. PATENT DOCUMENTS

| | | | | |
|---|---|---|---|---|
| 2,737,326 | A | 3/1956 | Toensmeier | |
| 2,764,284 | A | 9/1956 | Arneson | |
| 2,950,041 | A | 8/1960 | Stone | |
| 3,245,711 | A | 4/1966 | Dantoin | |
| 3,493,261 | A * | 2/1970 | Stout et al. | 294/87.2 |
| 3,612,266 | A | 10/1971 | Graser | |
| 3,722,945 | A | 3/1973 | Wood | |
| 3,767,041 | A | 10/1973 | Graser | |
| 4,131,198 | A | 12/1978 | Fischer | |
| 4,164,286 | A | 8/1979 | Sutherland | |
| 4,188,766 | A | 2/1980 | Culpepper | |
| 4,192,540 | A | 3/1980 | Oliff | |
| 4,326,628 | A | 4/1982 | Wood | |
| 4,336,898 | A | 6/1982 | Joyce | |
| 4,432,579 | A * | 2/1984 | Denmark et al. | 294/87.2 |
| 4,438,843 | A | 3/1984 | Graser | |
| 4,489,880 | A | 12/1984 | Calvert | |
| 4,566,591 | A | 1/1986 | Turtschan et al. | |

(Continued)

FOREIGN PATENT DOCUMENTS

DE 196 42 571 A1 5/1997

(Continued)

OTHER PUBLICATIONS

JP Office Action mailed Jul. 4, 2011 for related Japanese application No. 2008-553327, Jun. 6, 2011.

*Primary Examiner* — J. Gregory Pickett
*Assistant Examiner* — Ernesto Grano
(74) *Attorney, Agent, or Firm* — Womble Carlyle Sandridge & Rice, LLP

(57) ABSTRACT

A package for holding a plurality of containers. The package has panels that extend at least partially around an interior of the package. The panels comprise a top panel, a bottom panel, and an intermediate panel. At least one bottom aperture in the bottom panel is for at least partially receiving a container of the plurality of containers. At least one intermediate aperture is in the intermediate panel for at least partially receiving the container. At least one retention flap foldably is attached to the intermediate panel adjacent to the at least one intermediate aperture. The at least one retention flap is for providing a retention force to the container to restrain the container from removal from the package.

30 Claims, 5 Drawing Sheets

U.S. PATENT DOCUMENTS

| | | | | |
|---|---|---|---|---|
| 4,703,847 | A | | 11/1987 | Oliff |
| 5,135,104 | A | | 8/1992 | Jorba |
| 5,188,225 | A | | 2/1993 | Jorba |
| 5,323,895 | A | * | 6/1994 | Sutherland et al. ..... 206/147 |
| 5,351,815 | A | | 10/1994 | Fogle et al. |
| 5,407,065 | A | | 4/1995 | Sutherland |
| 5,439,112 | A | | 8/1995 | De Guglielmo et al. |
| 5,445,262 | A | | 8/1995 | Sutherland |
| 5,484,059 | A | | 1/1996 | Sutherland |
| 5,503,267 | A | | 4/1996 | Sutherland |
| 5,588,586 | A | | 12/1996 | Negelen |
| 5,598,920 | A | | 2/1997 | Hansen |
| 5,620,094 | A | | 4/1997 | Naumann |
| 5,638,956 | A | | 6/1997 | Sutherland |
| 5,687,838 | A | | 11/1997 | Bakx |
| 5,845,776 | A | | 12/1998 | Galbierz et al. |
| 5,921,392 | A | | 7/1999 | Davis |
| 5,957,289 | A | | 9/1999 | Negelen |
| 5,960,945 | A | | 10/1999 | Sutherland |
| 5,984,086 | A | | 11/1999 | Foushee et al. |
| 6,021,897 | A | | 2/2000 | Sutherland |
| 6,223,892 | B1 | | 5/2001 | Bakx |
| 6,315,111 | B1 | | 11/2001 | Sutherland |
| 6,488,322 | B2 | | 12/2002 | Bakx |
| 6,615,984 | B2 | | 9/2003 | Saulas et al. |
| 7,083,046 | B2 | | 8/2006 | Bakx |
| 7,264,114 | B2 | | 9/2007 | Daniel |
| 2002/0113449 | A1 | | 8/2002 | Bakx |
| 2004/0079666 | A1 | | 4/2004 | Bakx |
| 2004/0226833 | A1 | | 11/2004 | Daniel |
| 2007/0000794 | A1 | | 1/2007 | Requena |
| 2008/0202946 | A1 | | 8/2008 | Jego |

FOREIGN PATENT DOCUMENTS

| | | | |
|---|---|---|---|
| DE | 203 17 334 | U1 | 2/2004 |
| DE | 20 2004 004 248 | U1 | 8/2004 |
| DE | 20 2004 017 954 | U1 | 2/2005 |
| EP | 0 048 506 | | 3/1982 |
| EP | 0 285 043 | A1 | 10/1988 |
| EP | 0 398 835 | B1 | 11/1990 |
| EP | 0 495 197 | A1 | 7/1992 |
| EP | 0 541 334 | A1 | 5/1993 |
| EP | 541334 | A1 | 5/1993 |
| EP | 0 780 320 | A1 | 6/1996 |
| EP | 1 070 671 | A1 | 1/2001 |
| EP | 1 384 679 | A1 | 1/2004 |
| EP | 1661813 | A1 | 5/2006 |
| FR | 1582235 | | 9/1969 |
| FR | 2 525 992 | | 11/1983 |
| FR | 2 664 239 | | 1/1992 |
| FR | 2 731 413 | | 9/1996 |
| GB | 1 342 180 | | 12/1973 |
| GB | 2 085 391 | A | 4/1982 |
| GB | 2 158 037 | A | 11/1985 |
| JP | 2004524234 | | 12/2004 |
| WO | WO 97/33807 | | 9/1997 |
| WO | WO 98/49071 | | 11/1998 |
| WO | WO 99/01356 | | 1/1999 |
| WO | WO 02/059011 | A2 | 8/2002 |
| WO | WO 02/062676 | A1 | 8/2002 |
| WO | WO 02/079048 | A1 | 10/2002 |
| WO | WO 03/016167 | A1 | 2/2003 |
| WO | WO 2005/095222 | A1 | 10/2005 |
| WO | WO 2006/044583 | A2 | 4/2006 |
| WO | WO 2006/108098 | A1 | 10/2006 |
| WO | WO 2007/044525 | A1 | 4/2007 |

* cited by examiner

PACKAGE FOR CONTAINERS

CROSS-REFERENCE TO RELATED APPLICATION

This application claims the benefit of U.S. Provisional Application No. 60/763,654, which was filed on Jan. 31, 2006. The entire content of the above-referenced provisional application is hereby incorporated by reference as if presented herein in its entirety.

BACKGROUND OF THE INVENTION

The present invention generally relates to packages or cartons for holding and displaying containers. More specifically, the invention is directed to a package having one or more retention flaps that engage the containers and at least partially restrain movement of the containers held by the package.

Packages or cartons for engaging upper portions of containers are known. The containers are typically inserted through apertures in a bottom panel of the package and secured by engaging a radially protruding part of the containers. One such package is disclosed in U.S. Pat. No. 6,223,891 to Bakx. Existing packages, however, may not sufficiently brace the containers, may be difficult to erect, and/or may occupy too much board space, which results in higher costs of construction. As such, a need exists for an improved package for holding and displaying containers.

SUMMARY OF THE INVENTION

In general, one aspect of the invention is directed to a package for holding a plurality of containers. The package comprises panels that extend at least partially around an interior of the package. The panels comprise a top panel, a bottom panel, and an intermediate panel. At least one bottom aperture is in the bottom panel for at least partially receiving a container of the plurality of containers. At least one intermediate aperture is in the intermediate panel for at least partially receiving the container. At least one retention flap is foldably attached to the intermediate panel adjacent to the at least one intermediate aperture. The retention flap is for providing a retention force to the container to restrain the container from removal from the package.

In another aspect, the invention is generally directed to a blank for forming a package for holding a plurality of containers. The blank comprises panels that include a top panel, a bottom panel, and an intermediate panel. At least one bottom aperture is in the bottom panel and at least one intermediate aperture is in the intermediate panel. At least one retention flap is foldably attached to the intermediate panel. The retention flap is adjacent to and at least partially defines the intermediate aperture.

In another aspect, the invention is generally directed to a method of forming a package for containing a plurality of containers. The method comprises providing a blank having a top panel, a bottom panel having at least one bottom panel aperture, an intermediate panel having at least one intermediate panel aperture and at least one retention flap foldably attached to the intermediate panel adjacent to the at least one intermediate aperture, a first side panel, and a second side panel. The method further comprises forming a sleeve by attaching the intermediate panel to at least one of the first and second side panels so that the intermediate panel is spaced apart from the bottom panel and the intermediate aperture and the bottom aperture are generally aligned for receiving a container.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present invention generally relates to constructs, sleeves, cartons, or the like, and packages for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Packages according to the present invention can accommodate containers of numerous different shapes. For the purpose of illustration and not for the purpose of limiting the scope of the invention, the following detailed description describes food product containers (e.g., plastic containers) at least partially disposed within the package embodiments. In this specification, the terms "lower," "bottom," "upper" and "top" indicate orientations determined in relation to fully erected packages.

The present embodiments are addressed to cartons or packages for attachment to and accommodation of containers. A package or carrier 150 is illustrated in its erected state in FIGS. 5 and 6, in which it is attached to containers C. In the illustrated embodiments the containers C are illustrated as single-serving beverage containers having a top portion generally comprising a flange portion F and an upper neck portion N, but other containers may be held in the package 150 without departing from the invention.

Figure 1:
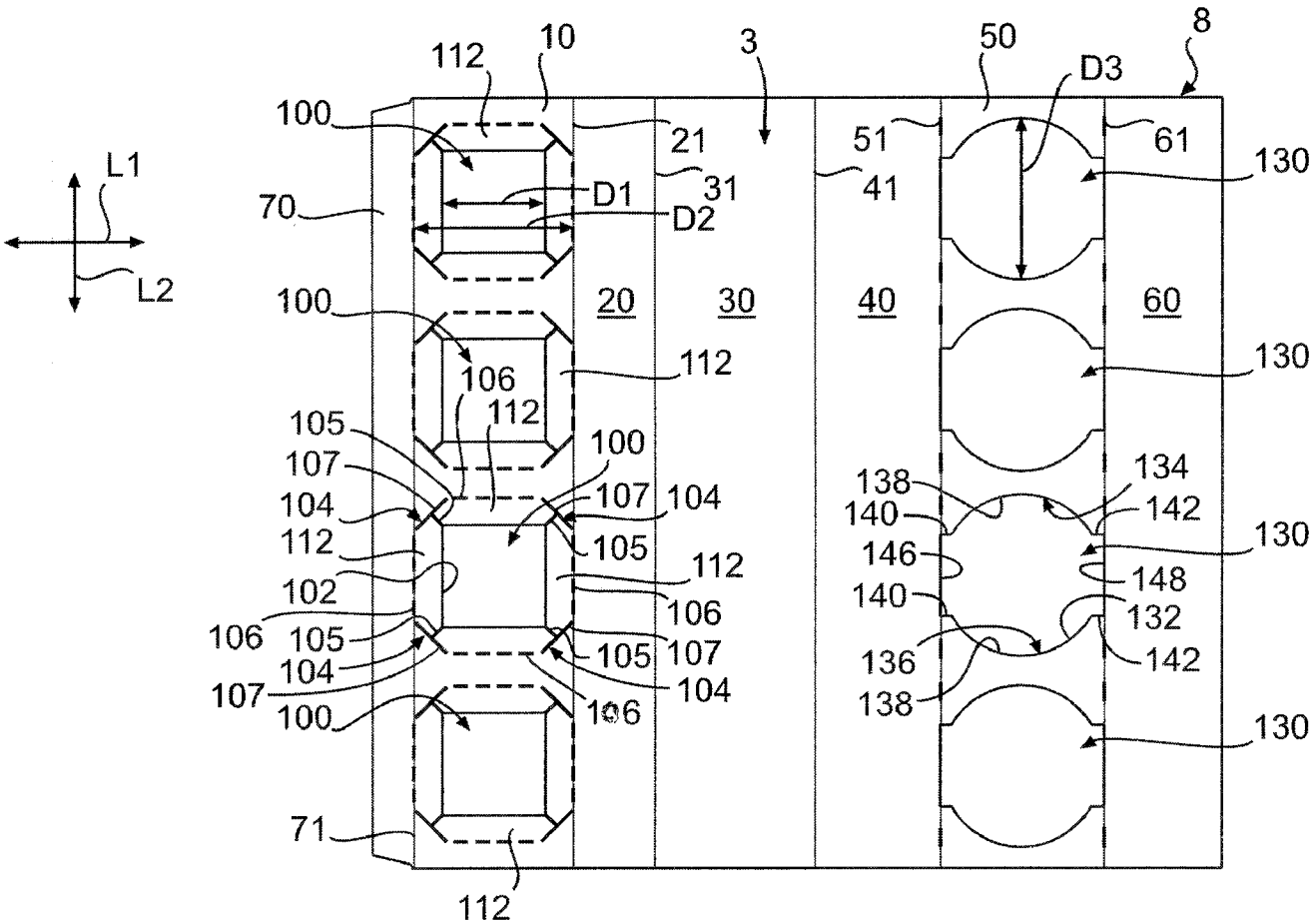
FIG. 1 is a plan view of a blank used to form a package according to one embodiment of the invention.

FIG. 1 is a plan view of an exterior side 3 of a blank 8 used to form the package or carrier 150. The blank 8 has a longitudinal axis L1 and a lateral axis L2. The blank 8 comprises an intermediate panel 10 foldably connected to a first adhesive panel 20 at a first transverse fold line 21, a top panel 30 foldably connected to the first adhesive panel 20 at a second transverse fold line 31, a first side panel 40 foldably connected to the top panel 30 at a third transverse fold line 41, a bottom panel 50 foldably connected to the first side panel 40 at a fourth transverse fold line 51, and a second side panel 60 foldably connected to the bottom panel 50 at a fifth transverse fold line 61. A second adhesive panel 70 can be foldably connected to the intermediate panel 10 at a sixth transverse fold line 71.

One or more cuts may be included in each of the transverse fold lines 21, 31, 41, 51, 61, 71 to facilitate folding along the fold lines. In the blank embodiment illustrated in FIG. 1, the transverse fold lines 21, 51, 61, 71 are cut/crease lines in which the cuts facilitate folding of the blank 8 at the fold lines. Any number of cuts may be formed in any of the fold lines, and the number and length of the cuts may be selected according to, for example, the gauge and/or the stiffness of the material used to form the blank 8. The fold lines 21, 51, 61, 71 may be formed by other methods (e.g., crease lines without cuts) without departing from the invention.

The intermediate panel 10 includes a plurality of intermediate apertures 100. Each intermediate aperture 100 is shaped and sized to receive an upper flange portion F of a container C (FIG. 5) that is to be at least partially accommodated within the package 150. The intermediate panel 10 includes four groups of retention flaps 112, with each group including four retention flaps foldably attached to the intermediate panel at orthogonal (e.g., either longitudinal or lateral) fold lines 106. In the illustrated embodiment, the orthogonal fold lines 106 extending in the lateral direction L2 comprises a portion of the lateral fold lines 21, 71. The retention flaps 112 are further defined by generally T-shaped slits or cuts 104 between adjacent ends of the retention flaps. The cuts 104 comprise a first slit or portion 105 extending obliquely from an edge of two adjacent retention flaps 112 and a second slit or portion 107 perpendicular to the first oblique portion and extending generally between adjacent ends of fold lines 106. In the illustrated embodiment, the expansion cuts 104 and the fold lines 106 define the pivotable flaps 112 in the intermediate panel 10, but the flaps may be otherwise shaped and arranged.

In one embodiment, the intermediate apertures 100 are generally square-shaped with each side define by a respective edge of the retention flaps 112. It is understood that the apertures 100 could be otherwise shaped and arranged without departing from the invention. As shown in FIG. 1, the intermediate apertures 100 each have an initial opening distance D1 generally defined as the space between the edges of the retention flaps 112 and a maximum opening distance D2 approximately equal to the distance between the respective fold line 106 of opposite retention flaps.

Figure 2:
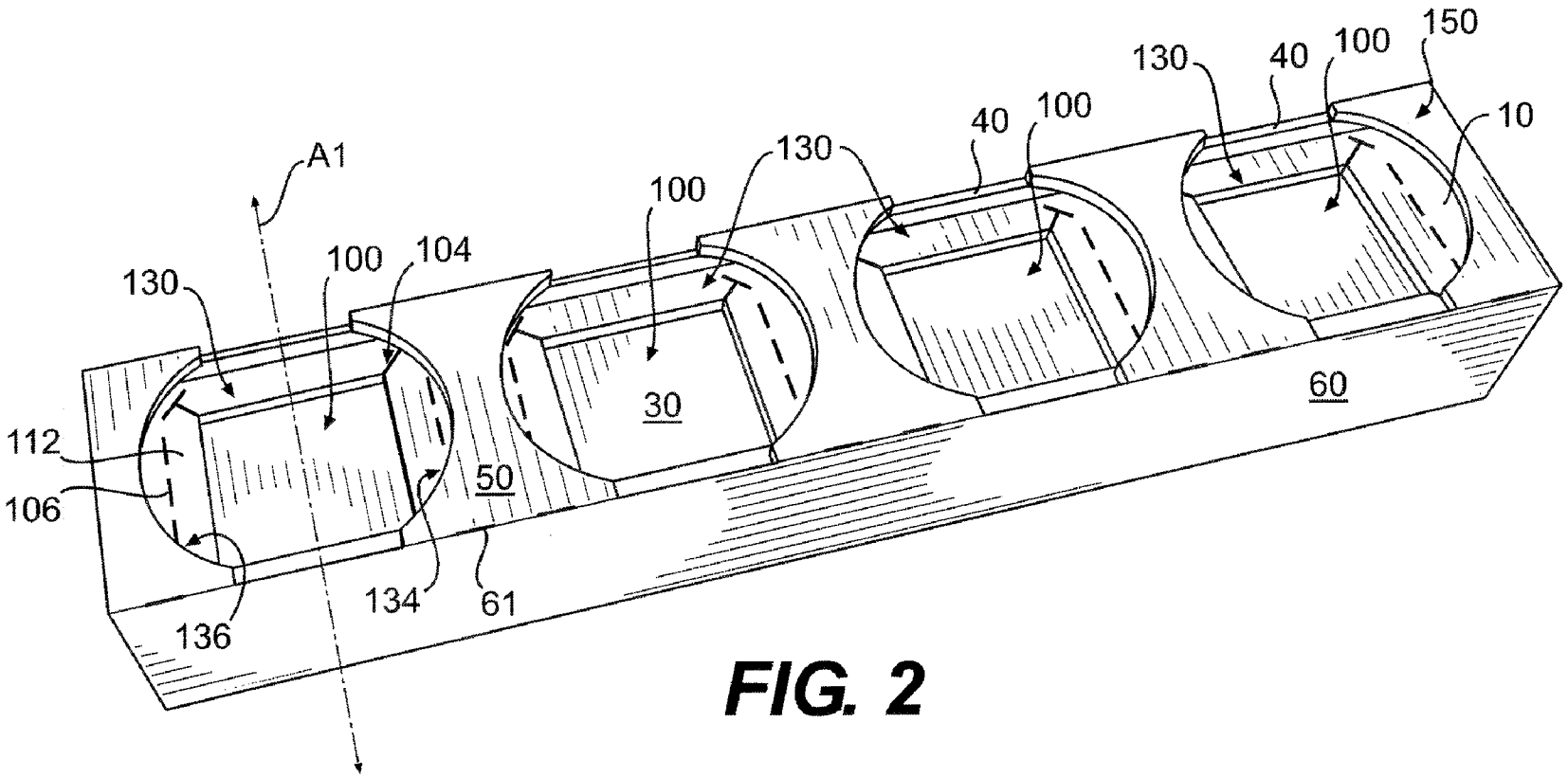
FIG. 2 is a bottom perspective of the blank of FIG. 1 assembled into the package.
Figure 3:
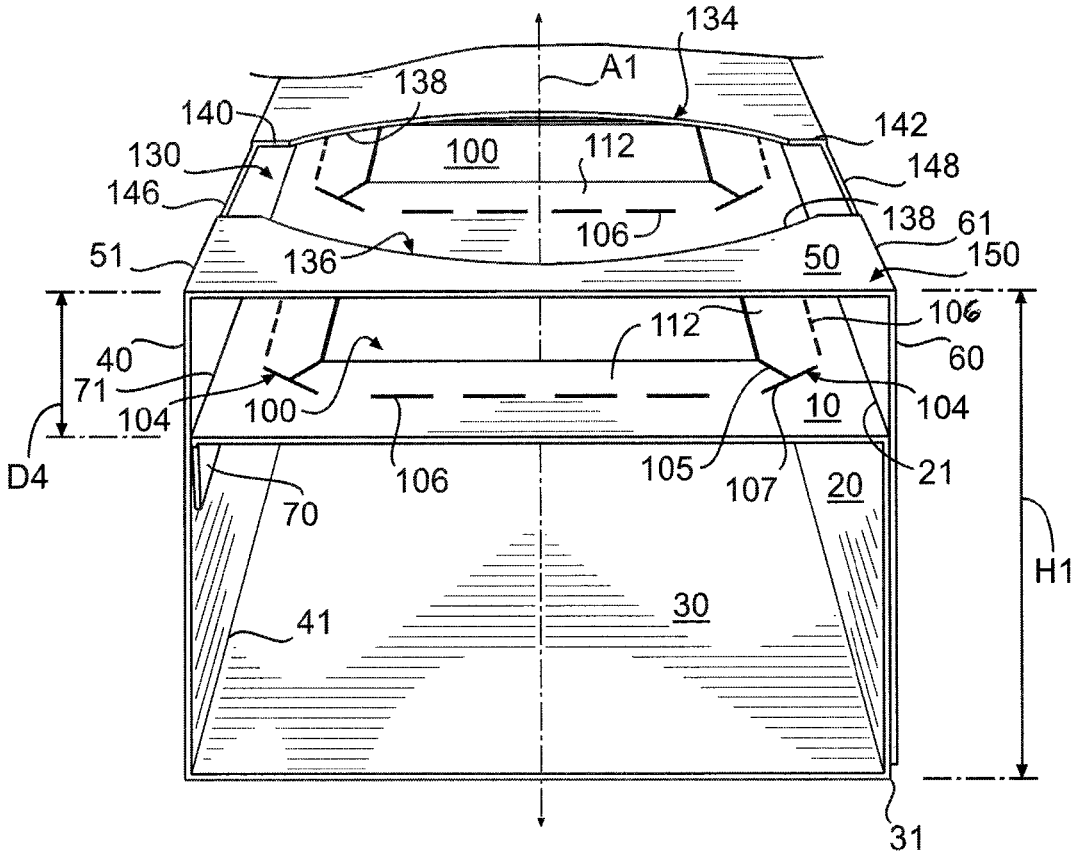
FIG. 3 is an end view of the package as shown in FIG. 2.
Figure 4:
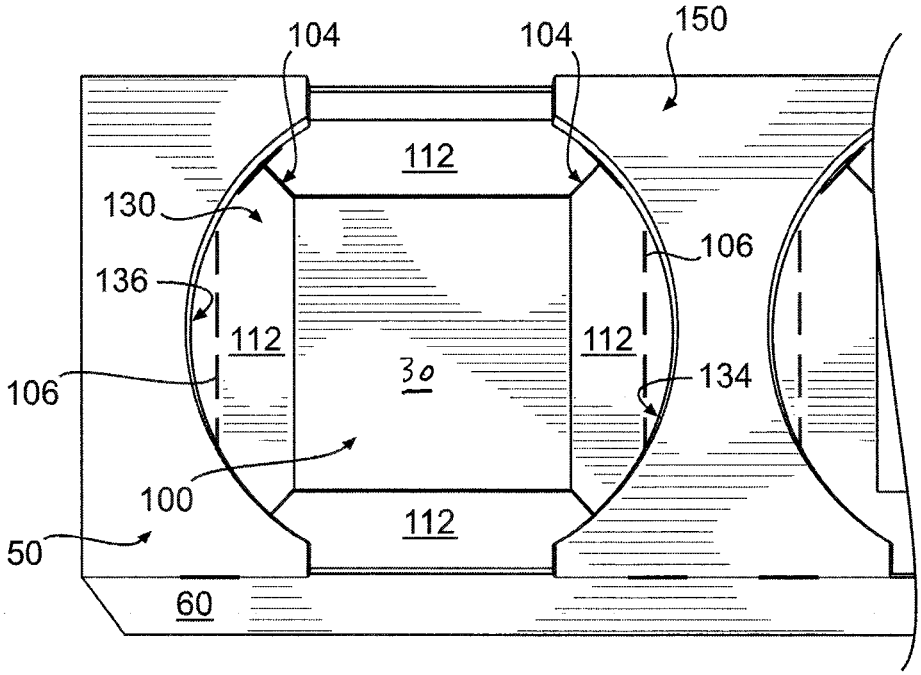
FIG. 4 is a partial view of the package as shown in FIG. 2.

The bottom panel 50 includes a plurality of bottom apertures 130. Each bottom aperture 130 may be shaped and sized to receive an upper neck portion N of a container C that is to be accommodated within the package 150. Each bottom aperture 130 is generally transversely aligned in the blank 8 with a corresponding intermediate aperture 100 of the intermediate panel. As shown in FIGS. 2-4 for the assembled package 150, each of the bottom apertures 130 are in registration with a corresponding intermediate aperture 100 so that a top flange portion F of a container C inserted into the package will first pass through the bottom aperture and then the corresponding intermediate aperture that is spaced above the bottom aperture. In the illustrated embodiment, a corresponding bottom aperture 130 and intermediate aperture 100, are axially aligned along a vertical axis A1 passing through the center of each aperture.

In the illustrated embodiment, the bottom panel 50 has first and second cuts 134, 136 that define laterally opposite sides of each bottom aperture 130. Each first and second cut 134, 136 includes an arcuate portion 138 and two longitudinally extending end portions 140, 142 extending to a respective lateral fold line 51, 61. The bottom panel 50 has third and fourth cuts 146, 148 that define longitudinally opposite sides of each bottom aperture. The third cuts 146 extend in the lateral direction L2 and are aligned with the lateral fold line 51. The fourth cuts 148 extend in the lateral direction L2 and are aligned with the lateral fold line 61. The bottom apertures 130 could be otherwise shaped and arranged without departing from the invention. The first and second cuts 134, 136 are sized and shaped to contact or be closely adjacent the neck portion N of the container C to help hold the containers in a stationary position relative to the package 150. In FIG. 1, for example, the arcuate portions 138 of the first and second cuts 134, 136 are designed to accommodate a container C with a circular horizontal cross-sectional shape. Containers having other perimeter profiles, however, may be accommodated by apertures having other sizes and shapes.

As shown in FIG. 1, the bottom apertures 130 have an opening distance D3 that is equal to the maximum distance between the arcuate portions 138 of the cut lines. In the illustrated embodiment the opening distance D3 is also equal to the longitudinal distance between the opposed lateral cut lines 146, 148 but it is understood that the bottom apertures 130 may be otherwise sized and shaped without departing from the invention.

In one embodiment, the opening distance D3 is greater than the initial opening distance D1 of the intermediate apertures and is approximately equal to the maximum opening distance D2 of the intermediate apertures. In one exemplary embodiment, the initial opening distance D1 may be in the range of approximately 80% to approximately 50% of the opening distance D3, preferably less than approximately 75% of the opening distance D3. In the illustrated embodiment, the distance D3 is approximately 2 inches (51 mm), the distance D1 is approximately 1¼ inches (32 mm), and the distance D2 is approximately 2 inches. In the assembled package 150, the intermediate panel 10 may be spaced apart from the bottom panel 50 a distance D4 (FIG. 3) of approximately ½ inch (13 mm) and the package 150 may have an overall height H1 between the bottom panel 50 and the top panel 30 of approximately 1½ inches (38 mm). Various other embodiments of the invention may vary from the dimensional information presented herein as these dimensions are intended to be illustrative only and is not to be interpreting in a limiting sense.

The package 150 may be erected by folding and gluing operations in a single pass through an assembly machine such as a folder gluer (not shown). Referring to FIG. 1, in one exemplary method of erection, the package 150 can be erected into a tubular sleeve by applying glue or other adhesive to the exterior (e.g., the side facing up in FIG. 1) of the adhesive panel 20, and to the exterior side (e.g., the side facing up in FIG. 1) or print side of the adhesive panel 70. The blank 8 may then be folded about the fold lines 21, 31, 41, 61, 71 so as to adhesively attach second adhesive panel 70 to the interior side (e.g., the side facing down in FIG. 1) of the first side panel 40 and to adhesively attach first adhesive panel 20 to the interior side (e.g., the side facing down in FIG. 1) of the second side panel 60. As shown in the inverted position (e.g., top panel 30 facing down) of FIG. 3, the intermediate panel 10 is generally spaced apart from and generally parallel to the bottom panel 50. As shown in FIGS. 2 and 3, when erected, the package 150 has a generally tubular shape with open ends. In the erected package 150, the top panel 30, the intermediate panel 10, and the bottom panel 50 are disposed in approximately parallel planes, and the first and second side panels 40, 60 extend from the top panel 30 to the bottom panel 50. Each intermediate aperture 100 in the intermediate panel 10 is vertically aligned with one of the bottom panel apertures 130 in the bottom panel 30. If desired, the package 150 can be collapsed into a substantially flat shape for shipping. The package 150 may be assembled by alternative methods without departing from the invention.

Figure 5:
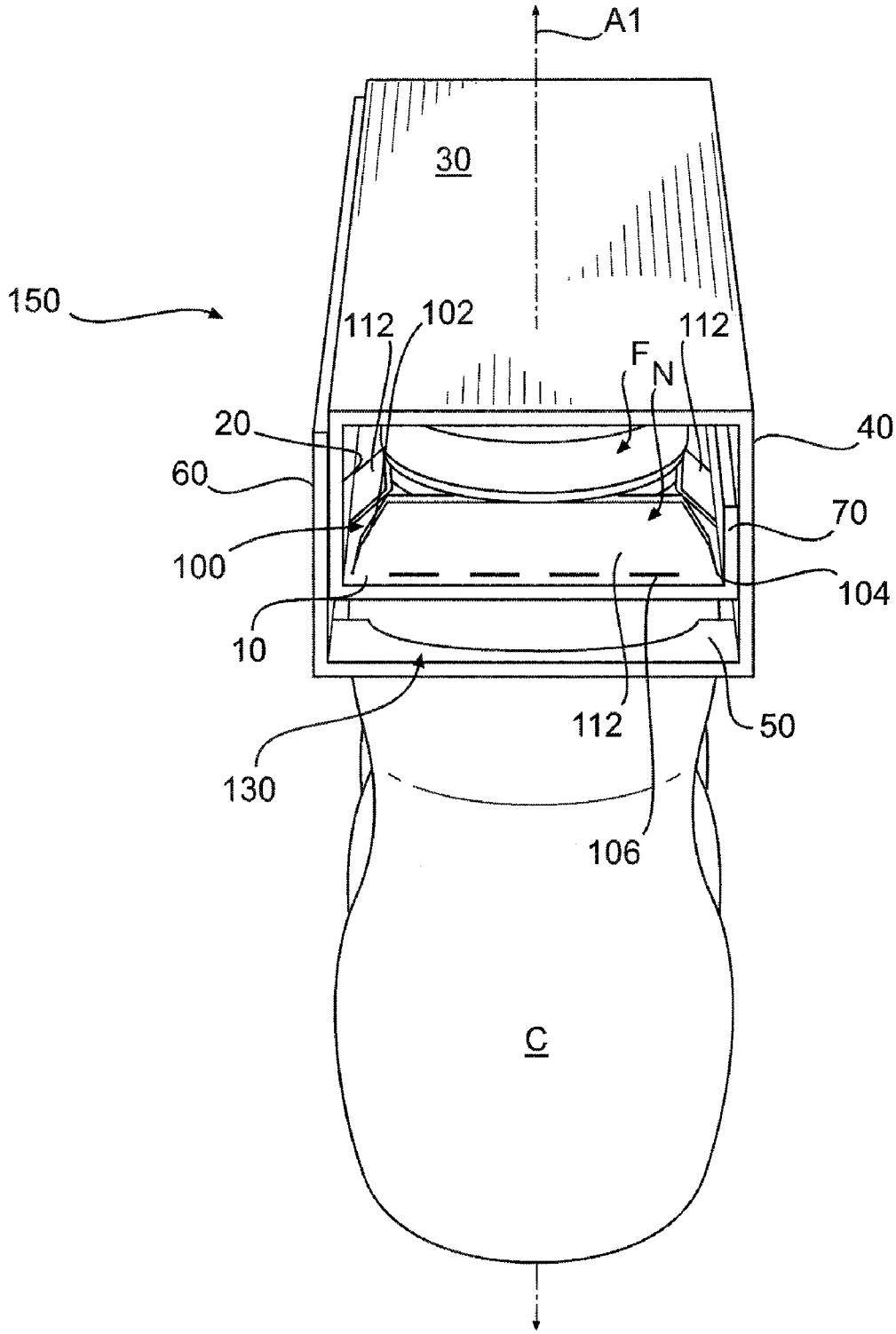
FIG. 5 is an end view of the package with containers held therein.
Figure 6:
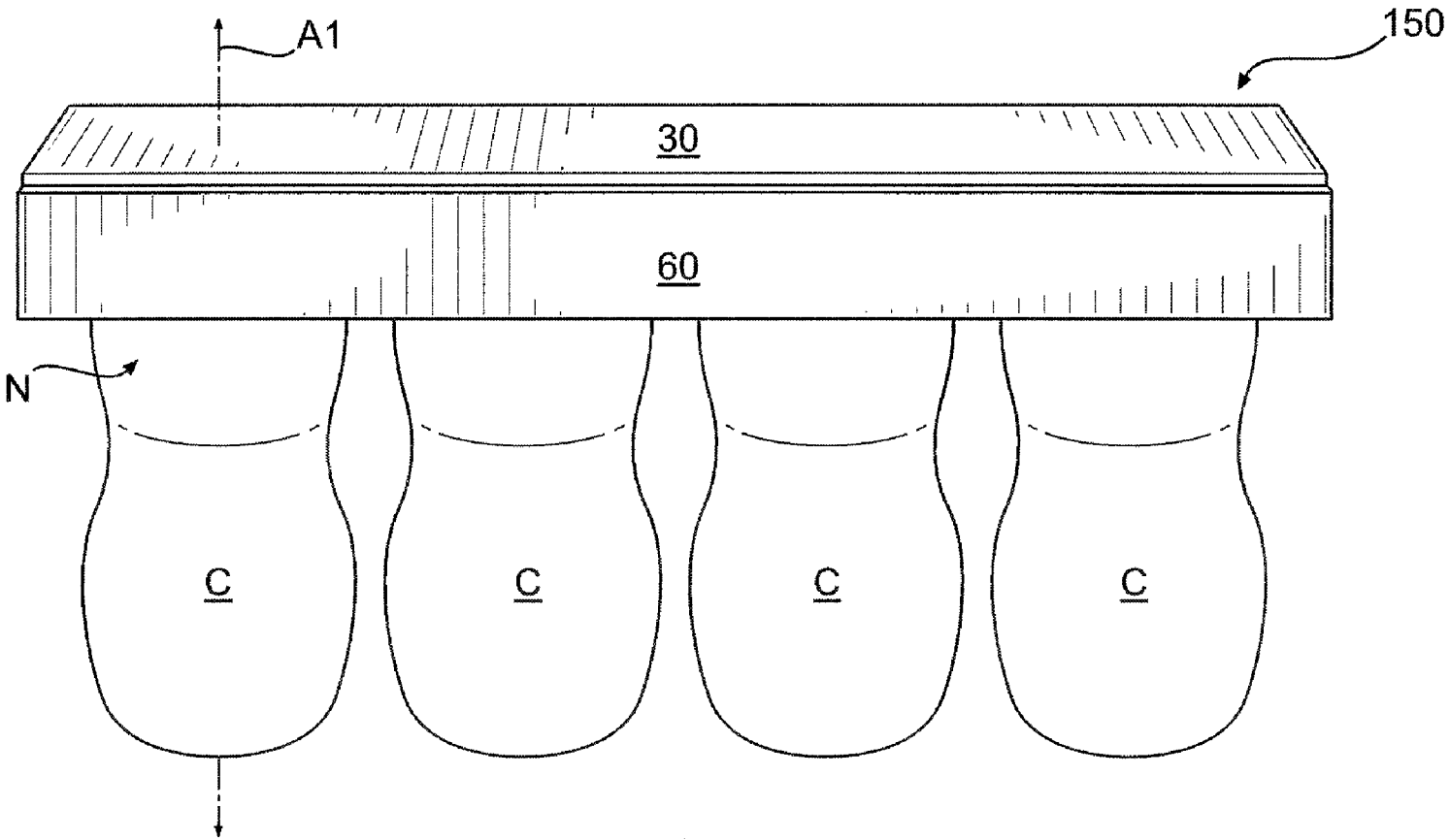
FIG. 6 is a side view of the package with containers held therein.

When the package 150 is erected, containers C can be mounted in the package by pressing the top flange portions F of the containers through the vertically aligned apertures 100, 130 in the bottom and intermediate panels 50, 10, respectively. In one application, the containers C can be aligned in a row, and the package 150 pressed down onto the row of containers so that multiple containers are simultaneously pressed into respective pairs of vertically aligned apertures 100, 130. As shown in FIG. 5, the top flange portions F of the containers C are disposed within an interior of the package 150, and the upper neck portions N of the containers are partially disposed within the interior of the package. As the top flange portion F of a container C is pressed through one of the intermediate apertures 100 in the intermediate panel 10, the container contacts the flaps 112 to fold the flaps upward along fold lines 106. As the container is further inserted, the flaps 112 are further folded upwardly, and the size of the intermediate aperture 100 is expanded from the initial opening distance D1. The flaps 112 then engage an underside or shoulder S of the flange portion F of the container C applying an retention force that tends to prevent withdrawal of the container from the package. The retention force from the engagement of the flaps 112 with the shoulder S of the flange portion F creates an upward bias force that must be overcome in order to withdraw the container C from the package 150.

The shape of the perimeter of the bottom panel apertures 130 may be, for example, wholly or partially complementary to the cross-sections of the containers C at the point where the containers C extend through the bottom panel apertures. For example, in the exemplary embodiment, the bottom panel apertures 130 include curved or arcuate sections 138 that are selected to substantially conform to a portion of the cross-sections of the containers C. The bottom panel apertures 130 may be selected to engage the containers C relatively tightly. The flaps 112 of the intermediate panel 10 may also be shaped and arranged to engage the underside of the shoulders S of the flange portions F relatively tightly. The containers C may thereby be securely retained from dropping out through the bottom of the package 150. In addition, the interaction between the cuts 134, 136 of the bottom panel 50 forming the bottom panel apertures 130 and the containers C may secure the containers against pivoting motion within the package 150.

The exemplary package embodiment discussed above accommodates four containers C arranged in a single row, but the present invention is not limited to these numbers. As one example, additional containers may be accommodated by increasing the size of the blank 8 (e.g., in the lateral direction L2 in FIG. 1) and forming additional container-receiving apertures therein. In another alternative embodiment, additional rows of containers may be accommodated by increasing the size of the intermediate and bottom panels 10, 50 (e.g., along the longitudinal direction L1 in FIG. 1) and adding additional rows of container-receiving apertures therein.

In the illustrated embodiment, the package 150 is shown as accommodating containers C having a generally round upper rim, cap, or flange portion F and as having an exterior contour defined by generally circular horizontal cross-sections. Other types, sizes, and shapes of containers, however, can be accommodated by a package according to principles of the present invention.

Furthermore, the bottom panel apertures 130 can be provided within expansion and retention features such as those present in the intermediate apertures 100. For example, if a container to be accommodated within the carton had a flange or shoulder at a lower or intermediate portion of the container, flaps may be formed at the perimeters of the bottom panel apertures 130. If the containers had multiple flanges, retentions flaps may be provided at both the bottom and intermediate panels.

In general, the blank may be constructed from paperboard having a caliper of at least about 14, for example, so that it is heavier and more rigid than ordinary paper. The blank can also be constructed of other materials, such as cardboard, or any other material having properties suitable for enabling the carton to function at least generally as described above.

The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

The above embodiments may be described as having one or panels adhered together by glue. The term "glue" is intended to encompass all manner of adhesives commonly used to secure paperboard carton panels in place.

The term "line" as used herein includes not only straight lines, but also other types of lines such as curved, curvilinear or angularly displaced lines.

In accordance with the exemplary embodiments, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The foregoing description of the invention illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention.

What is claimed is:

1. A package holding a plurality of containers, the containers each comprising a top flange portion, the package comprising:

panels that extend at least partially around an interior of the package, the panels comprise a top panel, a bottom panel, and an intermediate panel, wherein the top panel is foldably connected to a side panel by a first transverse fold line, the side panel is foldably connected to the bottom panel by a second transverse fold line, and the top panel is foldably connected to an adhesive panel by a third transverse fold line, the adhesive panel is foldably connected to the intermediate panel by a fourth transverse fold line, and wherein the interior of the package is at least partially formed by the top panel, the intermediate panel, the adhesive panel, and at least a portion of the side panel;

at least one bottom aperture in the bottom panel at least partially receiving a container of the plurality of containers;

at least one intermediate aperture in the intermediate panel at least partially receiving the container; and at least one retention flap foldably attached to the intermediate panel adjacent to the at least one intermediate aperture, wherein the at least one retention flap is for providing a retention force to the container to restrain the container from removal from the package by engaging an underside of the top flange portion of the container, wherein the retention flap engages the top flange portion of the container at a location that is disposed within the interior of the package; wherein the side panel is a first side panel, the panels further comprise a second side panel, and at least one adhesive flap, wherein the adhesive flap and the adhesive panel are respectively adhesively attached to the first and second side panels;

wherein each of the top panel, the side panel, and the adhesive panel is free from openings, the top panel has a top length and the bottom panel has a bottom length, and the top length is substantially equal to the bottom length.

2. The package of claim 1 wherein the at least one retention flap comprises at least two retention flaps at respective opposite sides of the intermediate aperture.

3. The package of claim 2 wherein the at least two retention flaps comprises four retention flaps.

4. The package of claim 3 wherein the intermediate aperture is a generally square-shaped opening and is at least partially defined by the four retention flaps.

5. The package of claim 1 wherein the at least one retention flap is at least partially defined by an orthogonal fold line in the intermediate panel.

6. The package of claim 5 wherein the at least one retention flap is at least partially defined by a first oblique cut line and a second oblique cut line that intersects with and extends generally perpendicularly from the first oblique cut line, wherein each of the first oblique cut line and the second oblique cut line is oblique with respect to the orthogonal fold line.

7. The package of claim 1 wherein the bottom aperture and the intermediate aperture are spaced-apart and axially aligned for receiving the container.

8. The package of claim 1 wherein the adhesive panel is adhesively attached to one of the first and second side panels to support the intermediate panel at a location spaced apart from the bottom panel.

9. The package of claim 1 wherein the bottom aperture has an opening distance and the intermediate aperture has an initial opening distance, the initial opening distance being less than the opening distance of the bottom aperture.

10. The package of claim 9 wherein the initial opening distance is less than approximately 75% of the opening distance of the bottom aperture.

11. The package of claim 9 wherein the intermediate aperture has a maximum opening distance approximately equal to the opening distance of the bottom aperture.

12. The package of claim 1 wherein the at least one bottom aperture comprises a plurality of bottom apertures and the at least one intermediate aperture comprises a plurality of intermediate apertures.

13. The package of claim 1 wherein the at least one retention flap comprises a first retention flap that is at least partially defined by at least a portion of the fourth transverse fold line, the first retention flap being foldably connected to the intermediate panel by the at least a portion of the fourth transverse fold line.

14. The package of claim 13 wherein the at least one retention flap further comprises a second retention flap that is connected to the intermediate panel at a longitudinal fold line.

15. The package of claim 14 wherein the first and second flaps are adjacent each other and are separated by a cut.

16. The package of claim 1 wherein the at least one retention flap extends out of the plane of the intermediate panel in a generally oblique direction with respect to the intermediate panel.

17. The package of claim 1 wherein the intermediate panel is spaced apart from the bottom panel a first distance and the top panel is spaced apart from the bottom panel a second distance, the second distance being at least twice the first distance.

18. The package of claim 17 wherein the second distance is about three times the first distance.

19. The package of claim 1, wherein the adhesive flap is foldably connected to the intermediate panel and extends upwardly from the intermediate panel towards the top panel, and wherein the second side panel is foldably connected to the bottom panel and extends upwardly from the bottom panel towards the top panel.

20. The package of claim 1, wherein the at least one retention flap extends upwardly from the intermediate panel toward the top panel.

21. The package of claim 1, wherein an uppermost surface of each container of the plurality of containers is disposed within the interior of the package adjacent an interior surface of the top panel.

22. The package of claim 1, wherein the top flange portion of each container of the plurality of containers comprises the entire portion of the container that is disposed above the at least one retention flap, and the entire top flange portion is disposed in the interior of the package.

23. A method of forming a package for containing a plurality of containers, the method comprising:

providing a blank having a top panel, a bottom panel having at least one bottom panel aperture, an intermediate panel having at least one intermediate panel aperture and at least one retention flap foldably attached to the intermediate panel adjacent to the at least one intermediate aperture, a first side panel, and a second side panel, wherein the top panel is foldably connected to the first side panel by a first transverse fold line, the first side panel is foldably connected to the bottom panel by a second transverse fold line, and wherein the top panel is foldably connected to an adhesive panel by a third transverse fold line, the adhesive panel is foldably connected to the intermediate panel by a fourth transverse fold line, wherein each of the top panel, the side panel, and the adhesive panel is free from openings, the top panel has a top length and the bottom panel has a bottom length, and the top length is substantially equal to the bottom length; and wherein at least one adhesive flap is foldably attached to the intermediate panel, and attaching the intermediate panel comprises folding the at least one adhesive flap and attaching the adhesive flap to at least the first side panel; and forming a sleeve by attaching the intermediate panel to at least one of the first and second side panels so that the intermediate panel is spaced apart from the bottom panel and the intermediate aperture and the bottom aperture are generally aligned for receiving a container with a top flange portion of the container disposed within an interior of the package, wherein the interior of the package is at least partially formed by the top panel, the intermediate panel, the adhesive panel, and at least a portion of the side panel; and at least partially inserting at least one container into the bottom aperture and intermediate aperture so that the at least one retention flap engages an underside of the top flange portion of the container at a location located within the interior of the package to at least partially inhibit withdrawal of the container from the package.

24. The method of claim 23 wherein the at least one retention flap extends out of the plane of the intermediate panel in a generally oblique direction with respect to the intermediate panel when engaging the top flange portion of the at least one container.

25. The method of claim 23 wherein the intermediate panel is spaced apart from the bottom panel a first distance and the top panel is spaced apart from the bottom panel a second distance, the second distance being at least twice the first distance.

26. The method of claim 25 wherein the second distance is about three times the first distance.

27. The method of claim 23 wherein the attaching the intermediate panel further comprises attaching the adhesive panel to the second side panel, wherein the adhesive flap extends upwardly from the intermediate panel towards the top panel, and wherein the second side panel is foldably connected to the bottom panel and extends upwardly from the bottom panel towards the top panel.

28. The method of claim 23, wherein the at least partially inserting at least one container into the bottom aperture and intermediate aperture comprises folding the at least one retention flap upwardly from the intermediate panel toward the top panel.

29. The method of claim 23, wherein the at least partially inserting at least one container into the bottom aperture and intermediate aperture comprises disposing an uppermost surface of the at least one container within the interior of the package adjacent an interior surface of the top panel.

30. The method of claim 23, wherein the at least partially inserting at least one container into the bottom aperture and intermediate aperture comprises positioning the entire top flange portion of the at least one container within the interior of the package, and wherein the top flange portion of each container of the plurality of containers comprises the entire portion of the container that is disposed above the at least one retention flap in the package.

* * * * *